US006055410A

United States Patent [19]

Marumoto et al.

[11] Patent Number: 6,055,410

[45] Date of Patent: Apr. 25, 2000

[54] BYPASS/STACK SHEET-FEEDING CONFIGURATION FOR MINIATURIZING ELECTROSTATOGRAPHIC APPARATUS

[75] Inventors: Takeshi Marumoto; Hiroyuki Tsuji, both of Osaka, Japan

[73] Assignee: Mita Industrial Co., Ltd., Osaka, Japan

[21] Appl. No.: 09/309,302

[22] Filed: May 11, 1999

[30] Foreign Application Priority Data

May 15, 1998 [JP] Japan ..... 10-134058

[51] Int. Cl.[7] ..... G03G 15/00

[52] U.S. Cl. ..... 399/392; 271/9.09; 271/9.11; 399/388

[58] Field of Search ..... 399/107, 110, 399/388, 391, 392, 393; 271/9.01, 9.09, 9.11, 9.13, 145

[56] References Cited

U.S. PATENT DOCUMENTS

| | | | |
|---|---|---|---|
| 4,639,114 | 1/1987 | Ide et al. | 399/392 X |
| 4,780,740 | 10/1988 | Fukae | 399/393 X |
| 5,116,034 | 5/1992 | Trask et al. | 271/9.11 X |
| 5,485,990 | 1/1996 | Kato | 271/9.09 X |

FOREIGN PATENT DOCUMENTS 9-269620 10/1997 Japan .

*Primary Examiner*—Sophia S. Chen
*Attorney, Agent, or Firm*—Shinjui An Intellectual Property Firm

[57] ABSTRACT

Bypass sheet-feeding section for an electro-statographic image reproducing apparatus employing vertical sheet transport from sheet supply cassettes to the image reproducing section. The bypass sheet-feeding section serves to hold special copying sheets such as cardboard, OHP sheets, and surface-coated paper; but it can also serve to hold a stack of, for example, conventional-sized copy paper. The bypass/stack sheet-feeding section is fitted with drawer guides, and includes a sheet-loading plate, a sheet-feeding pickup roller, a sheet-feed plying roller pair and a mechanism for moving the loading plate vertically. The bypass/stack sheet-feeding section can be withdrawn integrally when it is pulled out from the side of the copier main unit. In an electrostatographic image reproducing apparatus configured in accordance with the invention, at least the document table, the document-reading section, the sheet-feeding cassette installation section, and the bypass sheet-feeding section are arranged vertically in the copier casing into positions approximately stacked from a plan aspect. Thus the occupied installation area is significantly reduced.

7 Claims, 3 Drawing Sheets

BYPASS/STACK SHEET-FEEDING CONFIGURATION FOR MINIATURIZING ELECTROSTATOGRAPHIC APPARATUS

BACKGROUND OF THE INVENTION

1. Technical Field

The present invention relates to compact electrostatographic image reproducing apparatus. In particular, the invention relates to miniaturization of electro-statographic image reproducing machines that include a bypass paper-feeder for feeding specialized paper such as cardboard, OHP sheets, and surface-coated paper to the image reproduction section of the machines.

2. Description of Related Art

In electrostatographic image reproducing devices such as photocopiers, printers, and facsimile devices, miniaturizing is desired to reduce space requirements in offices. Typically, a plurality of sheet-feeding cassettes housing sheets are arranged in copiers according to sheet sizes used, and each sheet-feeding cassette can be inserted into and withdrawn from the machine.

Photocopying machines furthermore typically comprise a document table on which original documents for copying are loaded, provided on the upper surface of the copier. Light is shone on sheets loaded on the document table, and light reflected from these originals is converted into electrical signals by a CCD sensor or the like. The signals from the CCD sensor are used to reproduce a corresponding electrostatic latent image on the surface of a photosensitive drum in the copying machine. This electrostatic latent image is developed by a developing device within the machine to form a toner image. Then, the sheet superficially bearing the toner image is sent to a fixing device, also arranged within the machine, where the toner image is heated and fuse-fixed to the sheet.

The sheets generally used in electrostatographic image reproduction are sizes B5, B4, A4, and A3. Often, the size of the document table is made to accommodate the largest among these, A3-size documents, so that an entire A3-size document can fit on the table. Further, in the majority of cases, the sheet-feeding cassette installation section, into which the sheet-feeding cassettes are installable/removable, can be fitted with a sheet-feeding cassette that can hold A3-size paper.

Sheets drawn out from the sheet-feeding cassette installation section are transported to the image reproduction section through a sheet-feeding transport path. Sheets onto the surface of which a toner image has been transferred in the image reproduction section are sent through a discharge transport path to the fixing device, from which they are discharged to a discharge tray.

Herein, by disposing the document table and the sheet-feeding cassette installation section vertically such that they are approximately stacked from a plan aspect, and by configuring the positions of the sheet-feeding transport path, the image reproduction section, the discharge transport path, and the fixing device so as to make the sheet-transport direction perpendicular, a copying machine can be provided for which the installation area is only slightly larger than A3 size.

Herein, sheets drawn out from the sheet-feeding cassette make a sharply switching turn when transported along the vertically extending sheet-feeding transport path. Therefore, using specialized paper such as cardboard, OHP sheets, and surface-coated paper with this type of sheet-feeding cassette is difficult. Consequently, configurations are known in which a bypass tray capable of housing specialized paper is installed, with a bypass transport path constructed such that sheets transported from the bypass tray to the image reproducing section are not turned sharply.

In the image reproducing apparatus described above, ordinarily, the bypass tray is provided projecting from the side of the apparatus. In using this bypass tray, the sheets are loaded into the bypass tray projected from the side of the device. An input panel is used to designate the bypass tray as the sheet-feeding position from which sheets are to be supplied, and the start button is pressed.

Accordingly, in this type of image reproducing apparatus, the bypass tray juts out from the side of the apparatus main body. Thus, the actual installation area is made larger than the area occupied by the apparatus main body just by the size of the bypass tray.

SUMMARY OF THE INVENTION

The object of the present invention is to enable the installation area for an electrostatographic image reproducing apparatus to be minimal, while providing it with a bypass sheet-feeding section capable of supplying specialized paper such as cardboard, OHP sheets, and surface-coated paper.

An image reproducing apparatus according to the present invention includes: a document table having an upper surface on which documents are loaded; a document-reading section that reads document image information by shining light on a document loaded on the document table and detecting the light reflected back; an image reproducing section that develops the document image information read by the document-reading section as a toner image, and transfers the toner-developed image onto a sheet; a fixing device that by heating the toner image formed by the image reproducing section fuse-fixes it onto the sheet; a sheet-feeding cassette that houses sheets of paper for feeding to the image reproducing section; a sheet-feeding cassette installation section into which the sheet-feeding cassettes are installable; a bypass sheet-feeding section capable of holding special paper and feeding the special paper to the image reproducing section; and a casing holding the above elements therein. At least the document table, the document-reading section, the sheet-feeding cassette installation section, and the bypass sheet-feeding section are arranged vertically in the casing into positions approximately stacked from a plan aspect.

With an image reproducing apparatus thus, its installation area can correspond to the dimension of documents that are loaded on the document table as well as to the dimension of sheets housed in the sheet-feeding cassette. For example, the apparatus can be installed in an area occupying little greater than A3 size.

The bypass sheet-feeding section herein can be disposed between the sheet-feeding cassette installation section and the document-reading section.

The bypass sheet-feeding section can also be structured such that it is shiftable from the casing to expose at least a section thereof. In this configuration, the bypass sheet-feeding section can include: a tray on which sheets are loaded; a sheet-feeding roller for drawing out the sheets loaded on the tray; a pressing mechanism in the front end of the tray that presses the end portion of the sheets on the sheet-feeding roller; and a plying roller that plies, one by one, sheets drawn out by the sheet-feeding roller.

The bypass sheet-feeding section can also be configured to be shiftable with respect to the sheet-feeding cassette installation section in a direction different from the direction in which the sheet-feeding cassette is inserted and removed.

Furthermore, the bypass sheet-feeding section can be configured to be shiftable parallel to the direction in which paper is sent out from the bypass sheet-feeding section.

The foregoing and other objects, features, aspects and advantages of the present invention will become more apparent from the following detailed description in conjunction with the accompanying drawings.

DETAILED DESCRIPTION OF THE PREFERRED EMBODIMENTS

Figure 1:
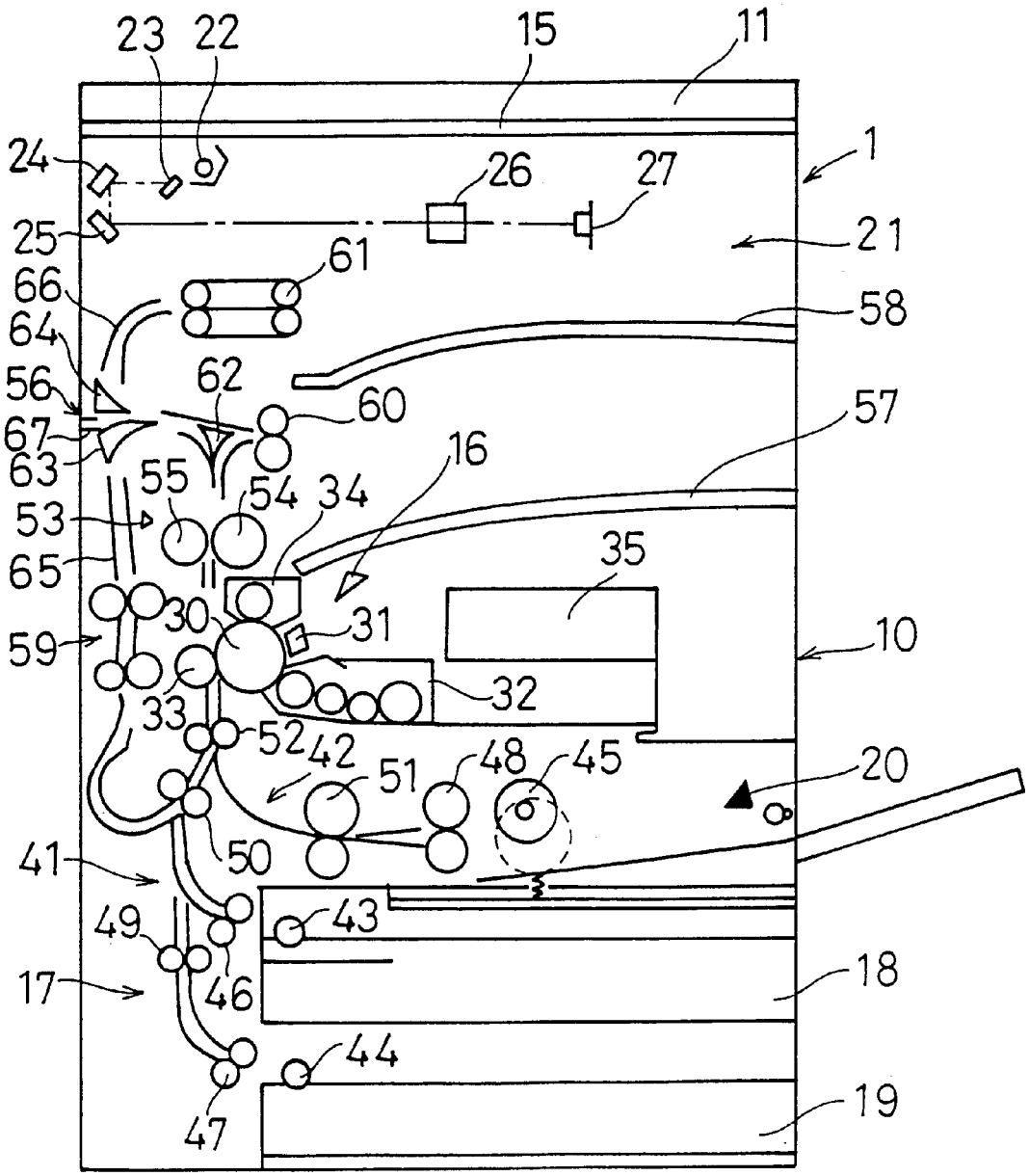
FIG. 1 is a schematic elevational section view of a photocopier employing a principal embodiment of the present invention.

FIG. 1 illustrates a vertical cross-section view of a photocopier according to an embodiment of the present invention.

A copier 1 includes a main unit 10 and a document holder 11 installed so that it can be opened and closed on an upper part the main unit 10.

A document table 15 onto which documents are loaded is disposed in the upper portion of the main unit 10. Inside the main unit 10 an image reproducing section 16 is disposed, which is provided on the left side, when seen from the front, in a roughly central position vertically. In the lower portion, a sheet-feeding section 17 is disposed for feeding documents to the image reproducing section 16.

The sheet-feeding section 17 (composing the sheet-feeding installation section) is provided with sheet-feeding cassettes 18, 19 removably attached to the main unit 10 for housing paper, and a bypass/stack sheet-feeding system 20 disposed above these.

Below the document table 15 an optical system 21 is disposed for reading image information from a document loaded on the document table 15. The optical system 21 includes: a light source 22 for shining light onto the surface of a document loaded on the document table 15; mirrors 23, 24, 25 for deflecting the light reflected from the document surface; a lens 26 for converging the light from the mirror 25; and an image pickup element 27 such as a CCD sensor that receives the light converged by the lens 26 and generates an image data signal corresponding to the document image.

The image reproducing section 16 includes a photosensitive drum 30 on the surface of which an electrostatic latent image is formed, and further includes on the periphery of the photosensitive drum 30 a primary charging device 31; a developing device 32; a transfer roller 33; and a cleaning device 34.

The primary charging device 31 is an device for charging the surface of the photosensitive drum 30 and is disposed to the right and above the photosensitive drum 30. The developing device 32, which forms a toner image on the photosensitive drum 30, is disposed to the lower right of the photosensitive drum 30 at a prescribed distance from the primary charging device 31. The developing device 32 contains toner and uses the toner to develop the electrostatic latent image formed on the photosensitive drum 30. The transfer roller 33 is an device used to transfer the toner image on the photosensitive drum 30 to a sheet and is disposed to the left of the photosensitive drum 30. The cleaning device 34 is an device for the removal of residual toner and the like from the surface of the photosensitive drum 30 and is disposed above the photosensitive drum 30. A laser unit 35, which forms the electrostatic latent image on the peripheral surface of the photosensitive drum 30, is disposed to the right of the photosensitive drum 30. The laser unit 35 forms electrostatic latent images on the peripheral surface of the photosensitive drum 30 in accordance with image data signals obtained from the image pickup element 27.

The sheet-feeding section 17 includes: vertical transport paths 41 for transporting sheets from the sheet-feeding cassettes 18, 19 toward the image reproducing section 16; and a bypass transport path 42 for transporting sheets from the bypass/stack sheet-feeding system 20 toward the image reproducing section 16. The sheet-feeding cassettes 18, 19, and the bypass/stack sheet-feeding system 20, are provided with: respective sheet-feeding pickup rollers 43, 44, and 45, for taking out housed sheets; as well as respective sheet-feeding roller pairs 46, 47, and 48, for sending sheets to the respective transport paths 41 and 42 one sheet at a time. Transport roller pairs 49, 50 are disposed along the vertical transport paths 41, and a transport roller pair 51 is disposed on the bypass transport path 42. The bypass transport path 42 bends in a curvature that is larger than the curvature defined by the bend in the vertical transport paths 41 from the respective sheet-feeding roller pairs 46, 47 toward the vertical.

The vertical transport paths 41 and the bypass transport path 42 merge below a transfer position where the photosensitive drum 30 and the image transfer roller 33 are opposed. At this merged point, a resist roller 52 is provided, which holds on standby in a predetermined position sheets that are being transported.

A fixing device 53 is disposed above the photosensitive drum 30 and the image-transfer roller 33 to fuse-fix toner transferred onto copy sheets. The fixing device 53 includes a heating roller 54, which contains a heater, and a pressure roller 55, which presses against the heating roller 54. The toner image superficially formed a sheet is heated and fixed while the sheets is nipped between both rollers 54, 55 and transported through the fixing device 53.

A branching section 56 is provided further upward than the fixing device 53.

A discharge tray 57 into which sheets are ejected by an output roller pair 60 is disposed to the right of the branching section 56. Above the output tray 57 is disposed a sub-output tray 58, into which sheets are ejected via an output roller pair 61. To the lower left of the branching section 56 is disposed a switchback section 59 for reversing sheets during double-sided copying. The branching section 56 is equipped with a branching claw 62, which switches the sheet transport direction between the output tray 57 direction and the switchback section 59 direction. To the left of the branching claw 62 are disposed two branching claws 63, 64. Below these two branching claws 63, 64 is disposed a switchback transport path 65, which guides sheets to the switchback section 59. Above the branching claws 63, 64 is a sub-tray transport path 66, which guides sheets to the sub-tray 58. Between the two branching claws 63, 64 is a finisher transport path 67 that transports sheets to a finisher such as a sorter or staple sorter not shown in the figures. The branching claws 63, 64 can be switched to feed incoming sheets to the switchback transport path 65, the sub-tray transport path 66, or the finisher transport path 67.

Figure 2:
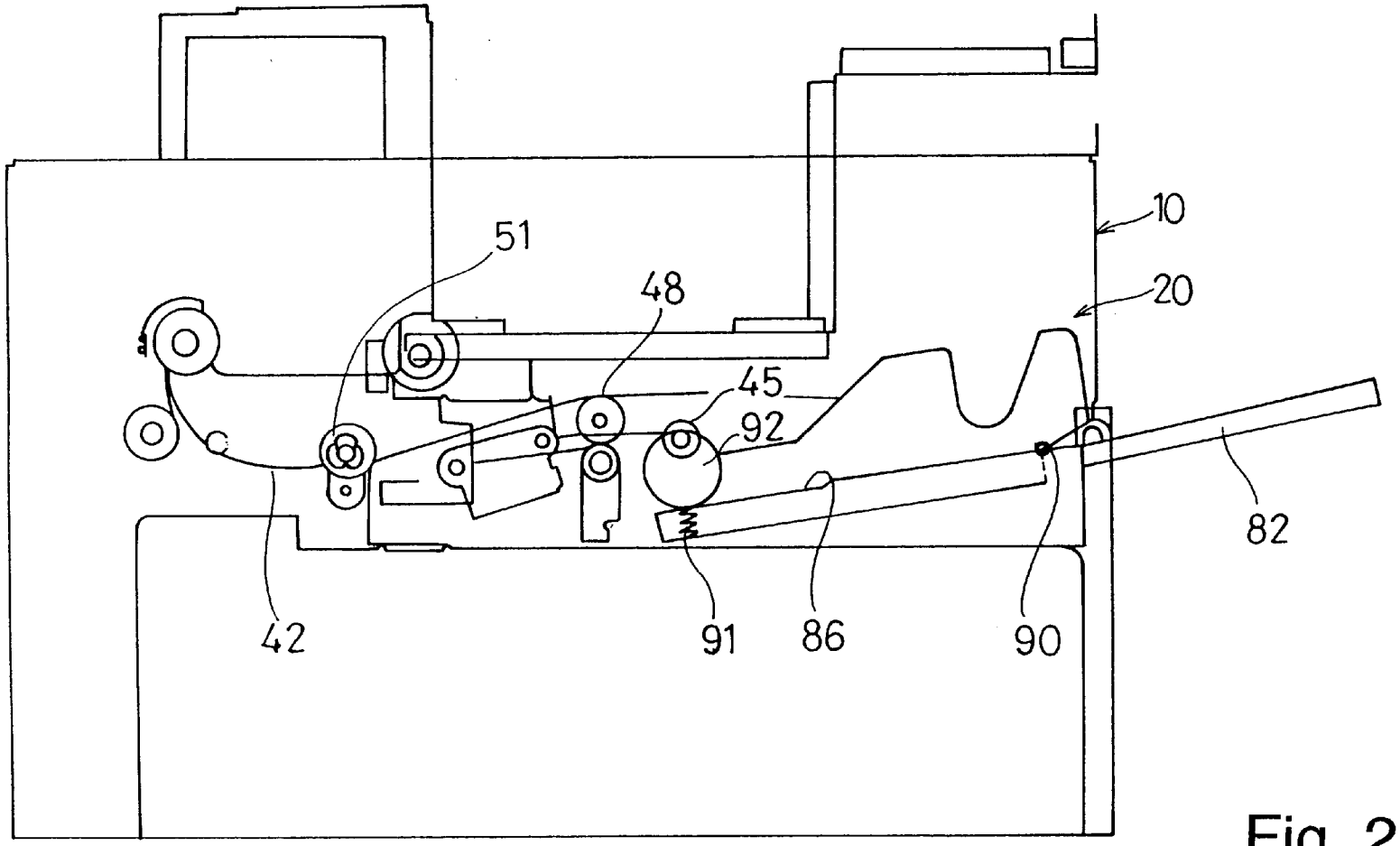
FIG. 2 is a schematic view partly corresponding to FIG. 1, but on an enlarged scale, illustrating details of a bypass sheet-feeding section of the photocopier.
Figure 3:
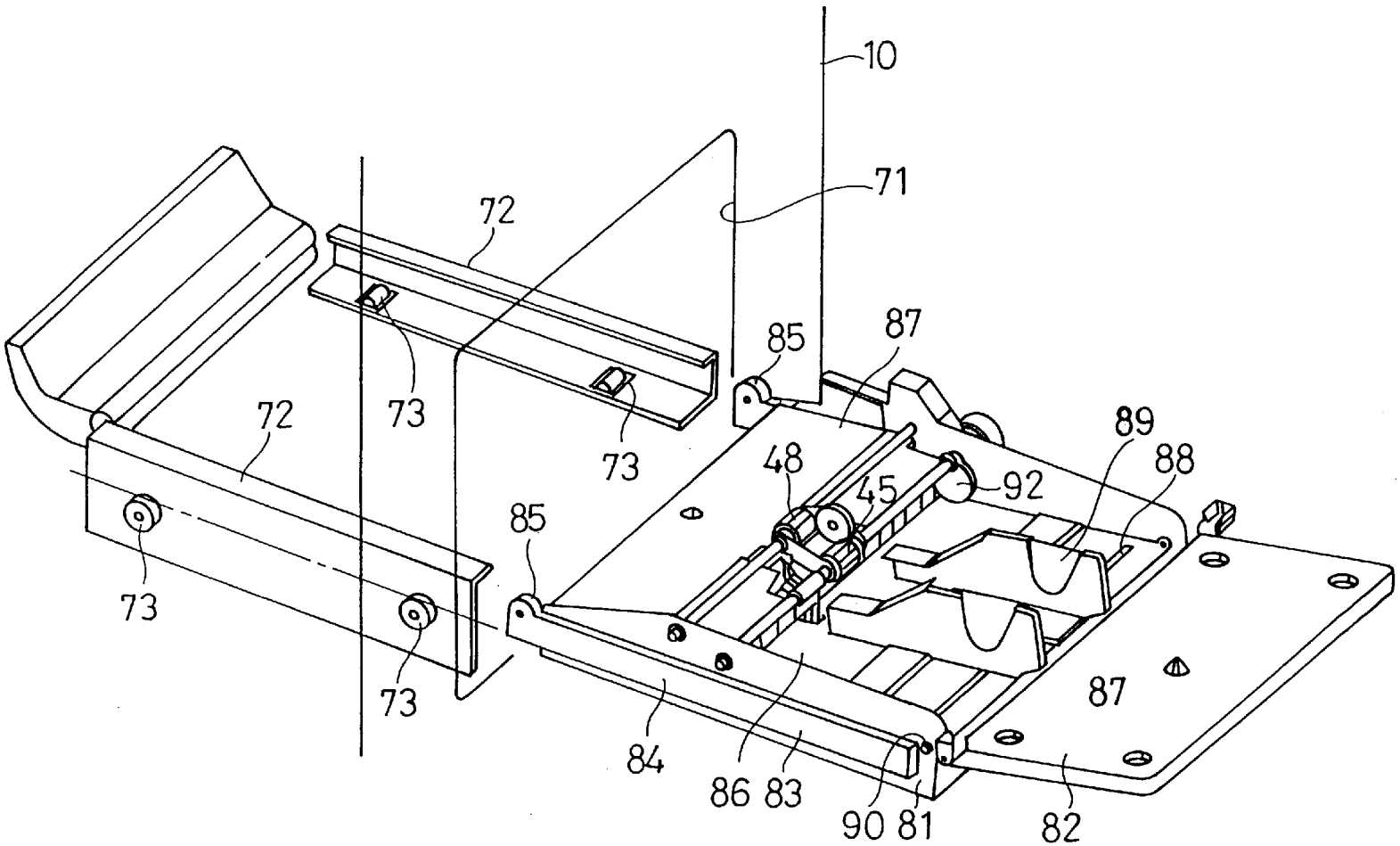
FIG. 3 is an exploded oblique view of components of the bypass sheet-feeding section.

The following is a description of the details of the bypass/stack sheet-feeding system 20, with references to FIG. 2 and FIG. 3.

The bypass/stack sheet-feeding system 20 includes a base 81 and a cover member 82 pivotably supported on the base 81. The base 81 is formed as a tray that includes a loading plate 86, on the upper surface of which sheets are loaded. Upward of the left end of the loading plate 86 are disposed a sheet-feeding pickup roller 45 for drawing out sheets, and the sheet-feed (plying) roller pair 48 for sending sheets to the transport path 42 one sheet at a time. To the left of the sheet-feed plying roller pair 48 is a guide surface 87 for guiding sheets to the transport path 42. Guided sections 83, 83, including guided rails 84 and guide rollers 85, are disposed along both sides of the base 81 (in the front-to-rear direction of the main unit 10). Corresponding to these, guide tracks 72 are disposed inside the main unit 10, the guide tracks 72 including guide rollers 73 for guiding the lower surface of the guided rails 84. The base 81 is guided by these guide tracks 72 and can be pulled out from an opening 71 provided on the right side of the main unit 10.

A guide groove 88 is formed on the loading plate 86. Partitioning plates 89, 89 are attached to the loading plate 86 and, engaged with the guide groove 88, are for laterally positioning sheets loaded onto the loading plate 86. The loading plate 86 is pivotable with respect to the base 81 via a pivot shaft 90, and is urged upward, in the direction in which the leading end position of the housed sheets is pushed upward. In this example, a spring 91 is disposed on the lower surface of the left end of the loading plate 86, urging the left end of the loading plate 86 upward.

Furthermore, cam members 92 abut on the upper surface of the loading plate 86. The cam members 92 are attached to either end of the rotator shaft of the sheet-feeding pickup roller 45 and abut on the upper surface of the loading plate 86 at the downstream end in the direction of sheet transport. When not driven, the cam member 92 keeps the upper surface of the loading plate 86 away from the sheet-feeding pickup roller 45 in opposition to the urging of the spring 91, as indicated in the figures. When the cam member 92 rotates, the cam surface rises. Accordingly, the loading plate 86 is configured such that by the urging of the spring 91, it travels into a position in which it approaches or comes into contact with the upper surface of the sheet-feeding pickup roller 45.

The cover member 82 is pivotably supported on the right end of the base 81, and when the base 81 is housed into a predetermined position within the main unit 10, the opening 71 can be closed off.

The sheets held in the bypass/stack sheet-feeding system 20 are transported through the bypass transport path 42 to the image reproducing section 16 without making any sharp turns or switchbacks. Consequently, the bypass/stack sheet-feeding system 20 is suited for feeding specialized paper such as cardboard, OHP sheets, and surface-coated paper to the image reproducing section 16.

With this bypass/stack sheet-feeding system 20, the cover member 82 can be closed with the loading plate 86 holding A4 landscape size paper. Since A4 size will probably be a paper size that is used often, if this type of paper is loaded on the loading plate 86 and the cover member 82 closed, paper will be set in the "bypass tray" and the portion projecting from the side of the main unit 10 disappears. Furthermore, the bypass/stack sheet-feeding system 20 is arranged so that the sheet-feeding cassettes 18, 19, the output tray 57, the sub-tray 58, and the document table 15 are arranged vertically into positions approximately stacked from a plan aspect, which therefore reduces the installation area to the utmost.

Furthermore, the bypass/stack sheet-feeding system 20 can be pulled out from the opening 71 disposed on the right side of the main unit 10. Thus, sheets can be easily loaded onto the loading plate 86, and even smaller sized sheets such as postcards and the like can be easily loaded. When the bypass/stack sheet-feeding system 20 is pulled out from the side of the main unit 10, the sheet-feeding pickup roller 45, the sheet-feed plying roller pair 48, and the mechanism for moving the loading plate 86 vertically are withdrawn integrally. This prevents misalignment of these mechanisms in connection with paper feeding.

Various details of the present invention may be changed without departing from its spirit nor its scope. Furthermore, the foregoing description of the embodiments according to the present invention are provided for illustration only, and not for the purpose of limiting the invention as defined by the appended claims and their equivalents.

What is claimed is:

1. In an electrostatographic printing apparatus having at least one vertical transport path for transporting sheets from sheet-feeding cassettes along a first curvature toward an image reproducing section therein, a bypass/stack sheet-feeding system configuration comprising:

a sheet-loading tray capable of bearing a stacked supply of sheets;

tray drawer rails flanking said sheet-loading tray in a sheet-feeding direction thereof;

drawer tracks disposed in a casing of the eletrostatographic printing apparatus for guiding said tray drawer rails;

a sheet-feeding pickup roller on a driven rotator shaft supported on said sheet-loading tray for drawing out sheets loaded thereon;

a pressing mechanism in the front end of said sheet-loading tray for pressing endwise sheets loaded thereon against said sheet-feeding pickup roller;

a bypass sheet-transport path disposed in the electrostatographic printing apparatus casing adjacent a leading end in the sheet-feeding direction of said sheet-loading tray for transporting sheets from said sheet-loading tray to the image reproducing section; and sheet-feed plying rollers for sequentially plying into said bypass sheet transport path sheets drawn out by said sheet-feeding pickup roller; wherein said bypass sheet-transport path curves from said sheet-feed plying rollers upward along a second curvature toward the image reproducing section larger than the first curvature.

2. A bypass/stack sheet-feeding system configuration as set forth in claim 1, wherein the casing of the electrostatographic printing apparatus contains a document table for bearing documents as copy originals, a document-reading section, an image reproducing section, a fixing apparatus, the sheet-feeding cassettes, and a sheet-feeding cassette installation section into which the sheet-feeding cassettes are installable and removable, and said sheet-loading tray; said bypass/stack sheet-feeding system configuration being such that at least the document table, the document-reading section, the sheet-feeding cassette installation section, and said bypass/stack sheet-feeding system configuration are arranged vertically in the casing into positions approximately stacked from a plan aspect.

3. A bypass/stack sheet-feeding system configuration as set forth in claim 1, wherein:

said sheet-loading tray is shiftable with respect to a sheet-feeding cassette installation section in a direction different from that along which the sheet-feeding cassettes are installable and removable.

4. A bypass/stack sheet-feeding system configuration as set forth in claim 1, wherein:

said sheet-loading tray is shiftable in a direction substantially parallel to that in which sheets drawn out by said sheet-feeding pickup roller are plied.

5. In an electrostatographic printing apparatus having a casing containing a document table for bearing documents as copy originals, a document-reading section, an image reproducing section, a fixing apparatus, sheet-feeding cassettes, and a sheet-feeding cassette installation section into which the sheet-feeding cassettes are installable and removable, wherein the electrostatographic printing apparatus has at least one curved transport path for transporting sheets from the sheet-feeding cassettes along a first curvature toward the image reproducing section, a bypass/stack sheet-feeding system configuration comprising:

a sheet-loading tray capable of bearing a stacked supply of sheets and specialized sheets for supply in a sheet-feeding direction of the electrostatographic printing apparatus;

a sheet-feeding means associated with said sheet-loading tray for feeding sheets and specialized sheets to the image reproducing section from said sheet-loading tray;

sheet-loading tray shifting means for shifting said sheet-loading tray into and out of a sheet-feeding location of said sheet-loading tray; and a bypass sheet-transport path disposed in the casing adjacent a sheet-feed leading end of said sheet-loading tray in its sheet-feeding location for transporting sheets and specialized sheets from said sheet-loading tray to the image reproducing section, wherein said bypass sheet-transport path curves from adjacent said sheet-loading tray along a second curvature toward the image reproducing section larger than the first curvature;

said bypass/stack sheet-feeding system configuration being such that at least the document table, the document-reading section, the sheet-feeding cassette installation section, and said bypass/stack sheet-feeding system configuration are arranged vertically in the casing into positions approximately stacked from a plan aspect.

6. A bypass/stack sheet-feeding system configuration as set forth in claim 5, wherein said sheet-loading tray, said sheet-feeding means associated with said sheet-loading tray, and said sheet-loading tray shifting means are disposed between the sheet-feeding cassette installation section and the document-reading section in the electrostatographic printing apparatus.

7. A bypass/stack sheet-feeding system configuration as set forth in claim 5, wherein said sheet-loading tray shifting means enables at least one section of said sheet-loading tray to be exposed from the casing.

* * * * *